US006682032B1

(12) United States Patent
Bradlee

(10) Patent No.: US 6,682,032 B1
(45) Date of Patent: Jan. 27, 2004

(54) BANANA BUNCH SUPPORT AND SUSPENSION DEVICE

(76) Inventor: Scott F. Bradlee, 5 Diane Dr., Saugus, MA (US) 01906

( * ) Notice: Subject to any disclaimer, the term of this patent is extended or adjusted under 35 U.S.C. 154(b) by 0 days.

(21) Appl. No.: 10/235,983

(22) Filed: Sep. 7, 2002

(51) Int. Cl.[7] ..... A47B 96/06; A47G 29/00; A46K 1/00

(52) U.S. Cl. ..... 248/215; 248/303; 248/304; 248/908

(58) Field of Search ..... 248/215, 303, 248/304, 914, 317, 908; D7/628; D6/450; 446/227, 228

(56) References Cited

U.S. PATENT DOCUMENTS

| | | | | | |
|---|---|---|---|---|---|
| D117,674 | S | * | 11/1939 | Lewis | |
| 2,707,610 | A | * | 5/1955 | Fillion | 248/215 |
| D175,240 | S | * | 7/1955 | Williamson | D8/367 |
| 3,175,798 | A | * | 3/1965 | Lewis | 248/306 |
| 3,902,266 | A | * | 9/1975 | Howard | 43/42.13 |
| 4,387,873 | A | * | 6/1983 | Pavlo et al. | 248/227.1 |
| 5,364,053 | A | * | 11/1994 | Rodgers | 248/302 |
| 5,391,104 | A | * | 2/1995 | George | 446/177 |
| D361,472 | S | | 8/1995 | Heilicher | D7/505 |
| D367,153 | S | * | 2/1996 | Sturm | D7/628 |
| 5,503,311 | A | * | 4/1996 | Chen | 223/85 |
| D369,482 | S | * | 5/1996 | McArdle | D6/450 |
| 5,826,843 | A | | 10/1998 | Sturm | 248/176.1 |
| D419,034 | S | | 1/2000 | Sturm | D7/628 |
| D421,712 | S | * | 3/2000 | Brown et al. | D8/370 |
| D430,791 | S | * | 9/2000 | Henry et al. | D8/367 |
| 6,155,526 | A | * | 12/2000 | Brown | 248/303 |
| D436,838 | S | * | 1/2001 | Kirk | D8/370 |
| 6,182,934 | B1 | * | 2/2001 | Kelley | 248/304 |
| 6,264,153 | B1 | * | 7/2001 | Ragner et al. | 248/311.2 |
| 6,416,026 | B1 | * | 7/2002 | Porraro | 248/317 |
| 6,422,521 | B1 | * | 7/2002 | Tinklepaugh et al. | 248/75 |
| 6,443,337 | B1 | * | 9/2002 | Muehlhauser | 223/85 |

* cited by examiner

*Primary Examiner*—Ramon O. Ramirez
*Assistant Examiner*—Amy J. Sterling
(74) *Attorney, Agent, or Firm*—Sturm & Fix LLP

(57) ABSTRACT

A device (10) for supporting and suspending a bunch of bananas (100) in a resiliently reciprocating fashion from a kitchen surface wherein the device (10) includes a generally rigid support member (20) contoured to resemble an animal (30) having a plurality of appendages (31) (32) etc., including a curved tail (35) that forms a support hook (21) for a bunch of bananas (100); wherein, a selected appendage (31) is provided with an aperture/recess (22) adapted to captively engage the lower end of a resilient tether member (40) the upper end of which is provided with an attachment member (50) such as a hook (51) for suspending the bunch of bananas from a hook, an eyelet, a shelf or the door pull of a kitchen cabinet.

19 Claims, 1 Drawing Sheet

BANANA BUNCH SUPPORT AND SUSPENSION DEVICE

CROSS REFERENCE TO RELATED APPLICATIONS

This invention was the subject matter of Document Disclosure Program Registration Number 509,516, filed in the United States Patent and Trademark Office on Aug. 10, 2002.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of amusing yet functional devices in general, and in particular to a unique apparatus for resiliently supporting and suspending a bunch of bananas.

2. Description of Related Art

As can be seen by reference to the following U.S. Pat. Nos. Des. 367,153; Des. 419,034; Des. 361,472; and 5,826,843, the prior art is replete with myriad and diverse banana bunch support and suspension devices.

While all of the aforementioned prior art constructions are more than adequate for the basic purpose and function for which they have been specifically designed, they are uniformly deficient with respect to their failure to provide a simple, efficient, and practical and amusing device for supporting and suspending a bunch of bananas in a humorous fashion; wherein, the removal of one or more bananas from the bunch will impart a vertically reciprocating motion to the device.

In today's environment with AIDS, natural disasters, and terrorist attacks, any humor that can be injected into our everyday lives serves as a brief but welcome relief and small comfort to counter our normal concerns and worries.

As a consequence of the foregoing situation, there exists a current need for a new, improved and humorous approach to suspending and supporting a bunch of bananas to both promote ripening and prevent discoloration or bruising of the banana skin; and, the provision of such a construction is a stated objective of the present invention.

BRIEF SUMMARY OF THE INVENTION

Briefly stated, the banana bunch suspension device that forms the basis of the present invention comprises in general an animal shaped banana support unit and a resilient suspension unit for suspending the banana support unit from a shelf, hook, or cabinet handle.

As will be explained in greater detail further on in the specification, the animal shaped banana support unit includes a generally rigid support member having the contour of a wild or domestic animal wherein, one of the simulated appendages of the animal is operatively connected to the lower end of the resilient suspension unit and one of the remaining appendages is formed into a generally curved support hook adapted to engage a bunch of bananas.

In addition, the suspension unit comprises a resilient generally elongated tether member the lower end of which is operatively connected to one of the appendages of the simulated animal and the upper end of which is provided with an attachment element such as a curved hook or suction cup.

As a consequence of the foregoing arrangement, as the user removes one or more bananas from the bunch, a vertical reciprocating motion will be imparted to the animal figurine thereby giving the visual impression that the simulated animal, such as a monkey, is expressing displeasure with the reduction of his food supply.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
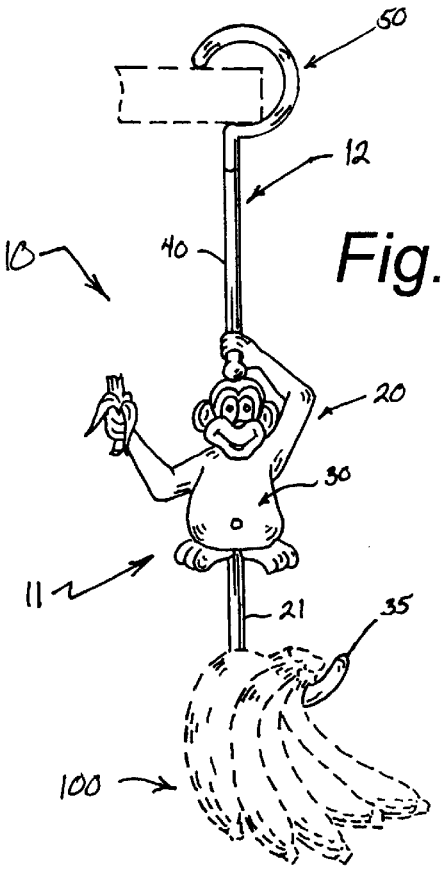
FIG. 1 is a perspective view of the banana support and suspension device in use.

As can be seen by reference to the drawings, and in particularly to FIG. 1, the banana bunch support and suspension device that forms the basis of the present invention is designated generally by the reference number 10. The device 10 comprises in general a support unit 11 and a resilient suspension unit 12. These units will now be described in seriatim fashion.

Figure 2:
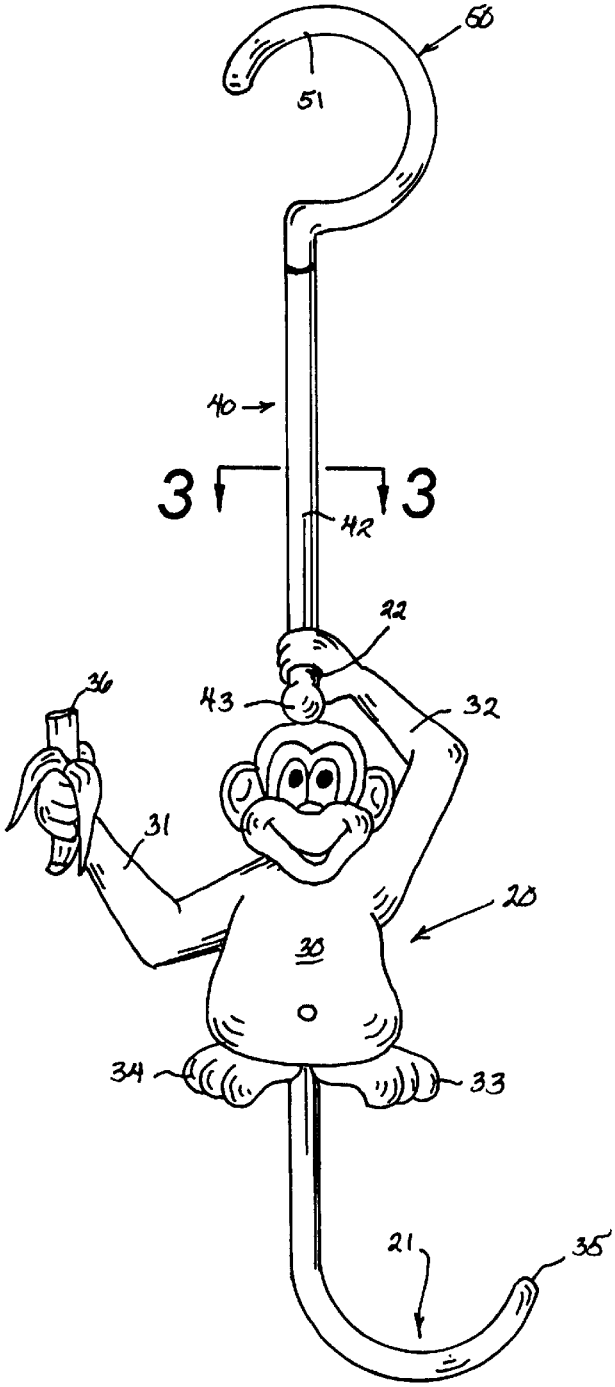
FIG. 2 is an isolated front plan view of the device.

As shown in FIGS. 1 and 2, the support unit 11 comprises a generally rigid support member 20 contoured to resemble an animal 30 provided with a plurality of appendages 31 32 33 34 35 representative of the animal's forelegs 31 32, rear legs 33 34 and tail 35.

As can be seen by reference to FIGS. 1 and 2, one of the animals appendages 35 is contoured to provide a support hook 21 adapted to captively engage the stem portion of a bunch of bananas 100 to support the bunch of bananas 100 in their natural orientation. This not only promotes the ripening of the bananas 100, but also prevents the bruising of the banana skin, such as would be caused by the bananas resting on a horizontal surface.

In addition, one of the remaining appendages 32 of the simulated animal is provided with a contoured recess or aperture 22 adapted to engage a portion of the suspension unit 12, as will be explained in greater detail further on in the specification.

At this juncture, it should be noted that the aperture/recess 22 formed in one of the simulated appendages 32 is axially aligned with the stem portion 21' of the J-shaped support hook 21 formed by another 25 of the simulated appendages 35.

It should further be noted that in keeping with the teachings of this invention, while the location of the support hook 21 and the aperture/recess 22 will always remain the same, the appendages 31 32 etc., in which they are located may be varied.

Obviously, in the preferred embodiment of the invention, illustrated in FIGS. 1 and 2, the ideal simulated animal configuration 30 will resemble a monkey since bananas represent one of their favored foods, plus the fact that monkeys are notorious for jumping up and down when they are excited or agitated. However, other, non-simian animal configurations can be substituted therefor, depending upon the preference of the user. The most commonly anticipated potential substitution being a domestic cat given the fierce loyalty and devotion exhibited by a significant number of cat owners.

As can also be seen in the preferred embodiment of FIGS. 1 and 2, in order to further enhance the visual and humorous appearance of the simulated animal 30 at least one of the appendages 31 is provided with the representation of a partially eaten, peeled banana 36.

Figure 3:
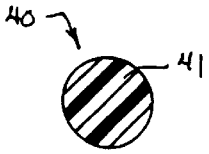
FIG. 3 is a cross-sectional view of the resilient suspension unit taken through line 3—3 of FIG. 2.

Turning now to FIGS. 1 through 3, it can be seen that the suspension unit 12 comprises an elongated resilient tether member 40 at least partially fabricated from a stretchy, elastic material 41 such as rubber or the like and preferably colored brown or green to resemble a natural vine or the like.

In addition, the intermediate portion 42 of the tether member 40 is dimensioned to pass through the mounting recess/aperture 22 in the support member 20; wherein, the lower end of the tether member is provided with a slightly enlarged portion 43 that cannot pass through the recess/aperture 22 and, wherein the upper end of the tether member 20 is provided with an attachment member 50 preferably in the form of a rigid hook 51 or in the alternative a suction cup (not shown); wherein, the attachment member 50 can suspend the tether member 40, the support member 20 and a bunch of bananas from a shelf, hook cabinet door or the like.

By now it should be appreciated that the banana support and suspension device 10 not only provides a practical way to store a bunch of bananas in a suspended fashion without wasting valuable kitchen counter space, but also does so in both an aesthetically appealing and humorous manner. Furthermore, it is not even necessary to remove any bananas from the bunch to produce the desired humorous effect. All that is necessary is to give the bunch of bananas 100 a downward tug and the simulated monkey will begin his dance of displeasure.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

What is claimed is:

1. A device for supporting and suspending a bunch of bananas in their natural orientation from an elevated kitchen surface wherein the device comprises:

a support unit including a generally rigid support member having a downwardly depending support hook adapted to engage the stem portion of a bunch of bananas; and, a suspension unit including at least in part an elongated resilient tether member having an upper end provided with a generally rigid attachment member; wherein, the tether member has a lower end that is operatively connected to a portion of the support member in a rotatable fashion to a selected stationary position relative to the support member and wherein the elongated resilient tether member provides unfettered vertical oscillation when a banana is pulled from the bunch.

2. The device as in claim 1; wherein, the support hook has a generally J-shaped configuration including a stem portion.

3. The device as in claim 2; wherein, the support member has an upper portion provided with a mounting recess/aperture.

4. The device as in claim 3; wherein, the mounting/recess aperture is generally aligned with the stem portion of the J-shaped support hook.

5. The device as in claim 4; wherein, the tether member has an intermediate portion dimensioned to pass through said mounting/recess aperture.

6. The device as in claim 5; wherein, the tether member has a lower end provided with an enlarged portion the exterior dimensions of which are greater than the interior dimensions of the mounting recess/apertures.

7. The device as in claim 1; wherein, the support member is configured to resemble an animal.

8. The device as in claim 2; wherein, the support member is configured to resemble an animal.

9. The device as in claim 3; wherein, the support member is configured to resemble an animal.

10. The device as in claim 4; wherein, the support member is configured to resemble an animal.

11. The device as in claim 5; wherein, the support member is configured to resemble an animal.

12. The device as in claim 6; wherein, the support member is configured to resemble an animal.

13. The device as in claim 7; wherein, the simulated animal is provided with a plurality of appendages including at least one leg and a tail.

14. The device as in claim 13; wherein the configuration of the support hook is intended to represent a selected one among said tail and said at least one leg.

15. The device as in claim 9; wherein the configuration of the support hook is intended to represent a selected one among said tail and said at least one leg.

16. The device as in claim 15; wherein the configuration of the support hook is intended to represent a selected one among said tail and said at least one leg.

17. The device as in claim 16; wherein, the mounting recess/aperture is disposed in the other among the selected one among said tail and said at least one leg.

18. The device as in claim 14; wherein, said at least one leg is selected from among a pair of forelegs and a pair of rear legs.

19. The device as in claim 17; wherein, said at least one leg is selected from among a pair of forelegs and a pair of rear legs.

* * * * *